US007571749B2

(12) United States Patent
Stocchi

(10) Patent No.: US 7,571,749 B2
(45) Date of Patent: Aug. 11, 2009

(54) FILLING VALVE FOR THE ASEPTIC FILLING OF ALIMENTARY LIQUIDS

(75) Inventor: Gabriele Stocchi, Parma (IT)

(73) Assignee: STK Stocchi Progetti SRL, Parma (IT)

( * ) Notice: Subject to any disclaimer, the term of this patent is extended or adjusted under 35 U.S.C. 154(b) by 400 days.

(21) Appl. No.: 10/530,059

(22) PCT Filed: Jun. 16, 2004

(86) PCT No.: PCT/IB2004/002002

§ 371 (c)(1),
(2), (4) Date: Sep. 8, 2006

(87) PCT Pub. No.: WO2005/003018

PCT Pub. Date: Jan. 13, 2005

(65) Prior Publication Data

US 2007/0074783 A1 Apr. 5, 2007

(30) Foreign Application Priority Data

Jul. 3, 2003 (IT) ..... BO2003A0411

(51) Int. Cl.
*B65B 1/04* (2006.01)

(52) U.S. Cl. ..... 141/91; 141/90; 141/105; 222/152; 222/190

(58) Field of Classification Search ..... 141/11, 141/57, 63, 64, 90–92, 105; 53/111, 425, 53/426; 222/190, 152
See application file for complete search history.

(56) References Cited

U.S. PATENT DOCUMENTS

| | | | | | |
|---|---|---|---|---|---|
| 4,436,124 | A | | 3/1984 | Borstelmann | |
| 4,832,096 | A | * | 5/1989 | Kohlbach | 141/114 |
| 5,445,194 | A | * | 8/1995 | Clusserath | 141/39 |
| 5,450,882 | A | * | 9/1995 | Cragun | 141/9 |
| 5,558,135 | A | * | 9/1996 | Kronseder et al. | 141/6 |
| 5,564,481 | A | * | 10/1996 | Clusserath | 141/92 |
| 5,860,461 | A | * | 1/1999 | Helmut | 141/326 |
| 5,896,899 | A | * | 4/1999 | Schmitz | 141/92 |
| 6,457,497 | B1 | * | 10/2002 | Adriansens et al. | 141/91 |

FOREIGN PATENT DOCUMENTS

| | | |
|---|---|---|
| DE | 42 19 082 | 12/1993 |
| EP | 0 409 798 | 1/1991 |
| EP | 0 574 321 | 12/1993 |
| EP | 1 323 667 | 7/2003 |

* cited by examiner

*Primary Examiner*—Timothy L Maust
(74) *Attorney, Agent, or Firm*—Oblon, Spivak, McClelland, Maier & Neustadt, P.C.

(57) ABSTRACT

Filling valve (7) for the aseptic filling of alimentary liquids characterized by the fact that the product stream flowing from the valve, in the area near by the filling mouth of the container underneath, is isolated from the atmosphere through a coaxial flow of sterile and/or inert gas (10) fed by an auxiliary circuit (2) surrounding the outlet conduit of the flowing product.

8 Claims, 2 Drawing Sheets

FILLING VALVE FOR THE ASEPTIC FILLING OF ALIMENTARY LIQUIDS

CROSS REFERENCE TO RELATED APPLICATION

This application is a 371 of PCT/IB04/002002, filed on Jun. 16, 2004, and claims priority of Italian Patent Application No. BO 2003A 000411, filed on Jul. 3, 2003.

FIELD OF THE ART

The present invention concerns the technology of filling valves, in particular the aseptic filling of alimentary liquid. International classification B 67c.

STATE OF THE ART

It is known that a filling chamber pressurized with aseptic gas is used for the sterile bottling of alimentary liquids According to the current state of the art it is possible to guarantee the total sterility of the gases used, but not the total sterility of the environment in the pressurized chamber. As a matter of fact, the filling chamber, before being sterilized, is filled with the external atmosphere whose presence is gradually reduced by aseptic gas flushing. The presence of atmospheric residual elements can not be completely removed without the preliminary creation of the absolute vacuum.

Therefore, said system does not guarantee the aseptic conditions of the area between the outflow mouth of the aseptic product and the mouth of the container to be filled. In this area, the stream of the alimentary liquid comes in touch with the external atmosphere reducing the aseptic conditions of the filling process . The atmospheric gas of the container, which is expelled as the level of liquid increases during the filling, contributes to lowering the process sterility degree Furthermore, at the end of the filling process, the neck space of the filled container is filled with the atmospheric gas of the filling chamber, which generally contains a considerable amount of oxygen. This residual oxygen, inside the final package, generates oxidation that negatively affects the characteristics of the edible products.

The invention hereby described proposes an optimal solution to the problem guaranteeing the aseptic filling also in the critical area between the mouth of the container and the outflow mouth of the product coming from the filling valve. It is in such critical area that a special continuous sterile gas flushing must be used to protect the product entering the bottle. Furthermore, the continuous flushing of sterile or inert gas reduces the amount of oxygen in the neck space of the filled container.

DESCRIPTION

The invention is now disclosed with reference to the figures of the drawings attached to be considered as a non restrictive exemplification.

FIG. 1 shows schematically the presence of a continuous flow of sterile or inert gas (10) fed through an auxiliary circuit (2) in the space (8) that surrounds the body of the filling valve (7) also in the closing phase, that is the intercepting of the feeding of the product. It can be noticed that the stem (7) of the valve (7) is kept closed by compressed air fed by the conduit (5).

FIG. 2 represents the filling phase during which the flow of product, fed through the conduit (3), is always protected by the continuous stream of sterile and/or inert gas (10) fed by the auxiliary circuit (2). It should be pointed out that said flow (10) reduces the contact of the product with the external atmosphere improving the aseptic conditions of the filling process. It should be noticed that the opening of the filling valve is obtained by lifting the stem (6) by means of compressed air fed by the conduit (4).

Figure 5:
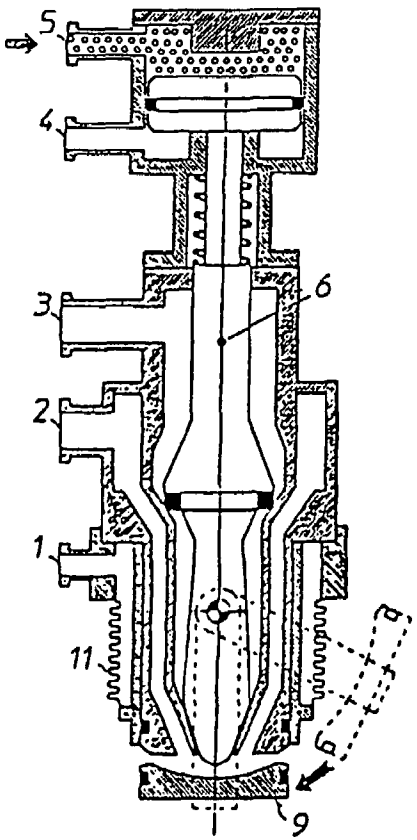

FIG. 5 shows the preparation of the filling valve for the sanitation of the filling plant. Please note the presence of the item (9) placed underneath by the outflow mouth of the valve. The stem (6) is kept lowered by compressed air fed by the conduit (5).

Figure 6:
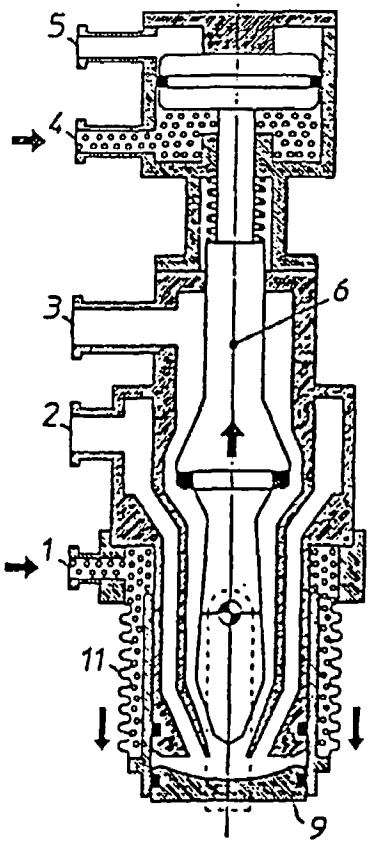

FIG. 6 shows the lowering of the sliding manifold (11) performed by a fluid fed by the conduit (1). In this way the outflow mouth of the filling valve is closed by the dummy bottle (9) and the stem (6) is lifted by compressed air through the conduit (4).

Figures 1, 2, 3, 4:
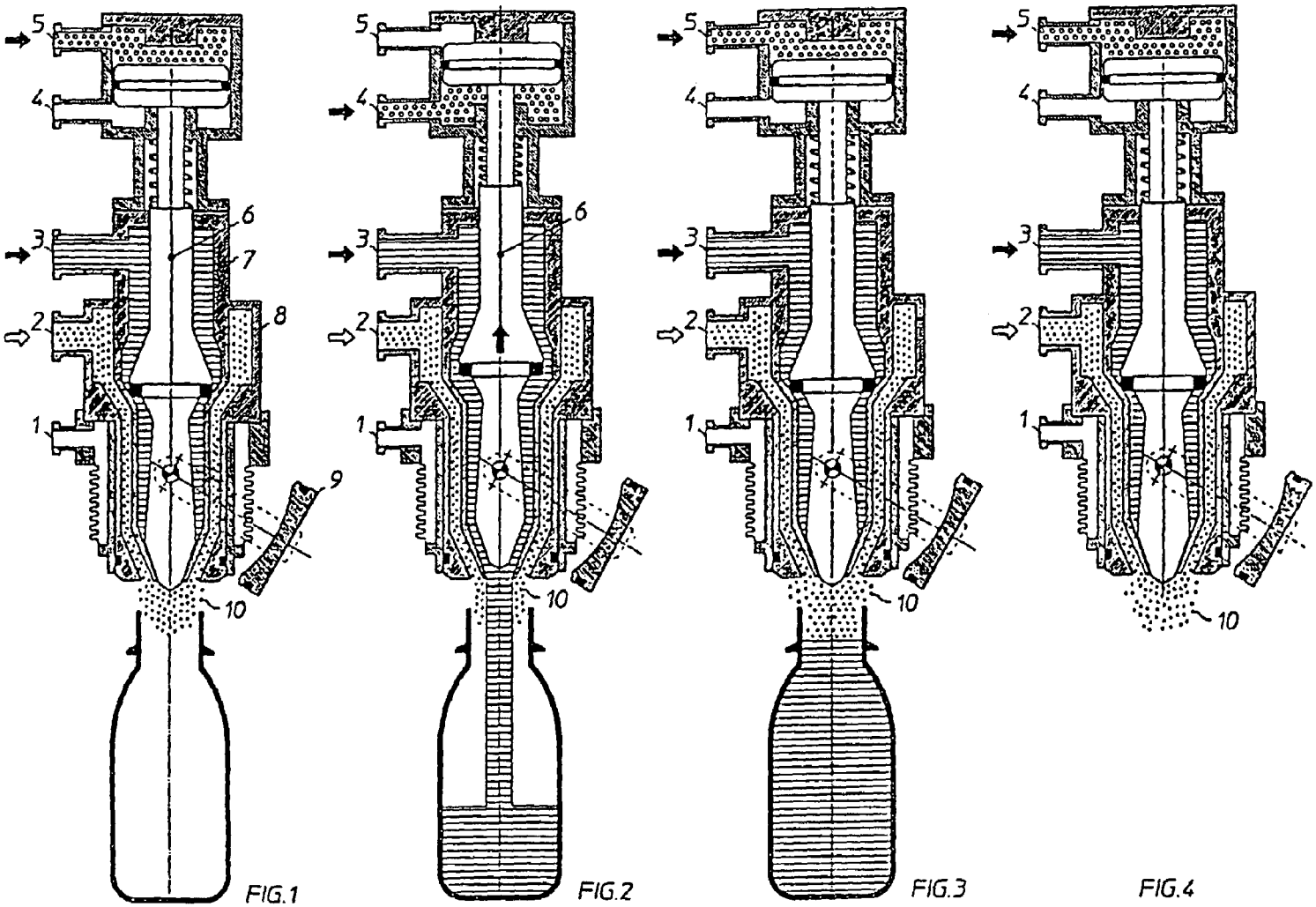
FIG. 3 represents the final phase of the filling; the outflow of sterile and/or inert gas (10) continues to reduce the presence of oxygen in the top space of the filled container. Please note the closing of the filling valve with compressed air fed by the conduit (5).
FIG. 4 shows the continuous presence of the flow (10) of aseptic or inert gas guaranteeing the protection of the filling valve outflow mouth also when it is closed.
Figure 7:
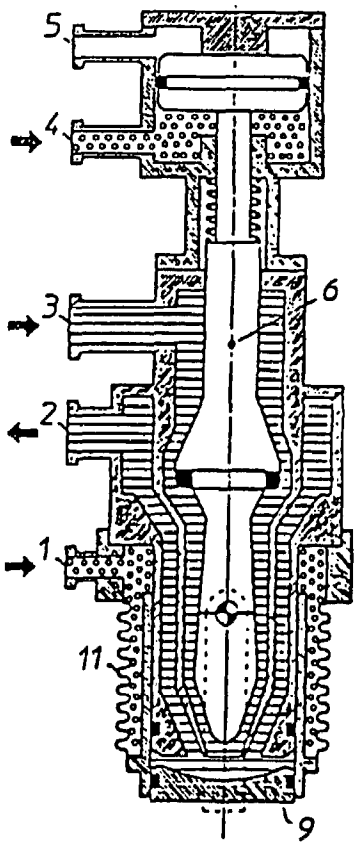

FIG. 7 shows the circulation of the sanitizing fluid coming from the conduit (3) and flowing out of it (2). Please note the dummy bottle (9) does not close the outflow mouth of the filling valve but guarantees its sanitization.

In the figures each single item is marked as follows:

1 indicates the inflow conduit of the flow that performs the lowering of the sliding manifold (11).

2 indicates the feeding conduit of an aseptic or inert fluid. It should be pointed out that this conduit is also utilized for the re-circulation of the sanitizing fluid.

3 indicates the feeding conduit of the filling circuit. It should be pointed out that this conduit is also used as inflow conduit for the sanitizing fluid.

4 indicates an inlet conduit of compressed air to lift up the stem of the intercepting valve.

5 indicates an inlet conduit of compressed air to lower the stem of the intercepting valve.

6 indicates the stem of the intercepting valve.

7 indicates the body of the valve.

8 indicates the inter-space that surrounds the body of the valve.

9 indicates the dummy bottle for sanitation.

10 indicates the continuous flow of aseptic or inert gas.

11 indicates a sliding manifold to close the dummy bottle.

The figures highlight the design simplicity as well as the reliability of the valve granting the aseptic conditions in all the critical areas of the aseptic liquids filling process.

Obviously the invention allows for several variations in terms of practical realization concerning the dimensioning and the structural proportioning as well as the technological choices of the material and the components used during construction.

The inventive core of the present invention lies in the creation of a flow of aseptic and/or sterile gas (10) that surrounds coaxially the stream of filling liquid, insulates it from the environment, and assures its aseptic conditions. Also, it protects the outflow mouth of the filling valve and the filling mouth of the container, reducing the presence of oxygen in the top part of the filled container. The feeding circuit of said aseptic and/or inert gas is also used to re-circulate the fluid used to sanitize the plant.

The invention claimed is:

1. A filling valve for an aseptic filling of alimentary liquids comprising:

a feeding conduit for a product stream to be filled in a container such that the product stream flows from a valve in an area near a filling mouth of the container underneath, wherein the product stream is isolated from the atmosphere by a coaxial flow of an aseptic gas, an inert gas, or a combination thereof, which is fed by an auxiliary circuit surrounding a filling valve outflow mouth, and wherein the auxiliary circuit, which is fed during a filling operation by a flow of the aseptic and/or inert gas for assuring an aseptic condition of the filling operation, is configured to be used for a re-circulation of a sanitizing fluid fed by the feeding conduit; and a lid, by which during sanitization of the filling mouth the valve is closed in cooperation with a sliding manifold, mounted on a body of the filling valve.

2. The filling valve according to claim 1, further comprising a valve stem.

3. The filling valve according to claim 1, further comprising at least one inlet conduit.

4. A filling valve for aseptic filling of alimentary liquids comprising:

a valve body;

a filling mouth;

a feeding conduit configured such that a product stream to be filled into a container flows through the valve body out of the filling mouth; and an auxiliary conduit configured to supply aseptic gas, inert gas, or a combination thereof and configured such that in an area near the filling mouth the product stream is isolated from the atmosphere by a coaxial flow of the aseptic gas, inert gas or combination thereof;

wherein the auxiliary conduit is arranged and configured such that the valve body is surrounded coaxially by the auxiliary conduit thereby ensuring that the aseptic gas, inert gas, or a combination thereof completely surrounds the product stream in a circumference direction;

the valve body is configured for continuous outflowing of aseptic gas, inert gas, or combination thereof through the filling mouth for reducing a presence of oxygen in a top part of the container;

the filling valve is configured to maintain the aseptic conditions of the filling valve also when the filling valve is closed;

the auxiliary conduit, which is fed during a filling operation by a flow of the aseptic gas, inert gas, or combination thereof, for assuring an aseptic condition of the filling process, is configured to be used for a re-circulation of a sanitizing fluid that is fed by the feeding conduit; and the filling mouth is closed by a lid in cooperation with a sliding manifold located on the valve body during sanitation of the filling valve.

5. The filling valve according to claim 4, further comprising a valve stem.

6. The filling valve according to claim 4, further comprising at least one inlet conduit.

7. The filling valve according to claim 4, further comprising an inter-space that surrounds the valve body.

8. The filling valve according to claim 4, further comprising an inter-space that surrounds the valve body.

* * * * *